US005711471A

United States Patent [19]

White

[11] Patent Number: 5,711,471

[45] Date of Patent: Jan. 27, 1998

[54] MAGNETIC BIASED DRIVING ELEMENT FOR A FASTENER DRIVING TOOL

[75] Inventor: Brian M. White, Riverside, R.I.

[73] Assignee: Stanley-Bostitch, Inc., East Greenwich, R.I.

[21] Appl. No.: 617,695

[22] Filed: Mar. 19, 1996

[51] Int. Cl.[6] ..... B25C 1/04

[52] U.S. Cl. ..... 227/113; 227/119; 227/130; 227/156

[58] Field of Search ..... 227/113, 119, 227/145, 149, 156, 130

[56] References Cited

U.S. PATENT DOCUMENTS

| | | | |
|---|---|---|---|
| 612,040 | 10/1898 | Hoofnagle | 227/113 |
| 3,820,705 | 6/1974 | Beals . | |
| 4,270,687 | 6/1981 | Maurer | 227/113 |
| 4,436,237 | 3/1984 | Vornberger et al. . | |
| 4,463,888 | 8/1984 | Geist et al. | 227/113 |
| 4,487,355 | 12/1984 | Ginnow et al. . | |
| 4,616,774 | 10/1986 | Yasuda . | |
| 5,199,625 | 4/1993 | Dewey et al. | 227/113 |
| 5,478,002 | 12/1995 | Clement et al. | 227/113 |

*Primary Examiner*—Scott A. Smith
*Attorney, Agent, or Firm*—Cushman, Darby & Cushman IP Group of Pillsbury Madison & Sutro LLP

[57] ABSTRACT

A fastener driving tool includes a portable housing defining a fastener drive track. A magazine assembly is carried by the housing for receiving a supply of fasteners and for feeding successive fasteners in a feeding direction into the drive track. A ferrous fastener driving element is mounted within the drive track for movement through repetitive cycles, each of which includes a fastener drive stroke in one direction in which a fastener within the drive track is engaged and moved outwardly of the drive track into a work piece, and a return stroke. A drive piston is operatively connected with the fastener driving element for movement therewith. An actuating mechanism is carried by the housing and is constructed and arranged to initiate movement of the fastener driving element through a fastener drive stroke. A magnet is mounted adjacent the drive track and is operatively associated with the fastener driving element so as to continuously bias the fastener driving element in the feeding direction of the successive fasteners such that during the drive stroke of the fastener driving element, the fastener driving element may engage a leading fastener of the successive fasteners without contacting an adjacent fastener of the supply.

7 Claims, 2 Drawing Sheets

MAGNETIC BIASED DRIVING ELEMENT FOR A FASTENER DRIVING TOOL

BACKGROUND OF THE INVENTION

This invention relates to devices for driving fasteners, and, more particularly, to a fastener driving tool including a magnet for biasing a fastener driving element away from a feeding direction of the fasteners while the fastener driving element is moving through a fastener drive stroke.

Portable fastener driving tools typically include a housing defining a fastener drive track, a magazine assembly carried by the housing for receiving a supply of fasteners and feeding successive fasteners into a drive track by a pusher, a fastener driving element mounted within the drive track for movement through repetitive cycles each of which includes a fastener drive stroke in one direction in which a fastener within the drive track is engaged and moved outwardly of the drive track into a work piece, and the return stroke. A drive piston is operatively connected with the fastener driving element for movement therewith and a trigger is carried by the housing and is constructed and arranged to initiate movement of the piston and the fastener driving element through a fastener drive stroke.

In these conventional fastener driving tools, the fastener drive track is typically recessed so as to accept the thickest fastener therein, with a clearance. Thus, in certain circumstances, the leading fastener and at least a portion of the next or second fastener may be disposed within the drive track. If the fastener to be driven is the last fastener in the magazine, that fastener and a portion of the pusher may be disposed within the drive track. In these situations, during a drive stroke of the tool, the fastener driving element may strike the second fastener or the pusher with tremendous force.

Typically when driving thin, wire fasteners, a chamfer is machined on the fastener driving element to ensure that the fastener driving element skids-off the second fastener or pusher. However, chamfering the end of the fastener driving element increases manufacturing cost. In addition, when the pusher is contacted by the fastener driving element during the drive stroke, the pusher edge may be swaged causing it to bind with the staple core. The pusher is generally heat-treated so as to increase its strength and to improve the likelihood that the pusher will not be severely damaged upon contact with the fastener driving element. However, heat-treating the pusher also adds to the manufacturing cost of the tool.

If the fasteners are provided in stick form, when the fastener driving element contacts the second fastener, the stick may break which may cause improper fastener feeding during successive operating cycles of the tool.

SUMMARY OF THE INVENTION

An object of the present invention is to provide a portable fastener driving tool including structure for continuously biasing the fastener driving element away from the feeding direction of fasteners.

This objective is achieved by providing a fastener driving tool comprising a portable housing defining a fastener drive track. A magazine assembly is carried by the housing for receiving a supply of fasteners and for feeding successive fasteners into the drive track. A ferrous fastener driving element is mounted within the drive track for movement through repetitive cycles, each of which includes a fastener drive stroke in one direction in which a fastener within the drive track is engaged and moved outwardly of the drive track into a work piece, and a return stroke. A drive piston is operatively connected with the fastener driving element for movement therewith. An actuating mechanism is carried by the housing and is constructed and arranged to initiate movement of the fastener driving element through a fastener drive stroke. A magnet is mounted adjacent the drive track and is operatively associated with the fastener driving element so as to continuously bias the fastener driving element in the feeding direction of the successive fasteners such that during the drive stroke of the fastener driving element, the fastener driving element may engage a leading fastener of the successive fasteners without contacting an adjacent fastener of the supply.

Another object of the present invention is the provision of a fastener driving tool of the type described, which is simple in construction, economical to manufacture and effective in operation.

These and other objects of the present invention will become more apparent during the course of the following detailed description and appended claims. The invention may best be understood with reference to the accompanying drawings wherein an illustrative embodiment is shown.

DETAILED DESCRIPTION OF THE PRESENTLY PREFERRED EXEMPLARY EMBODIMENT

Figure 1:
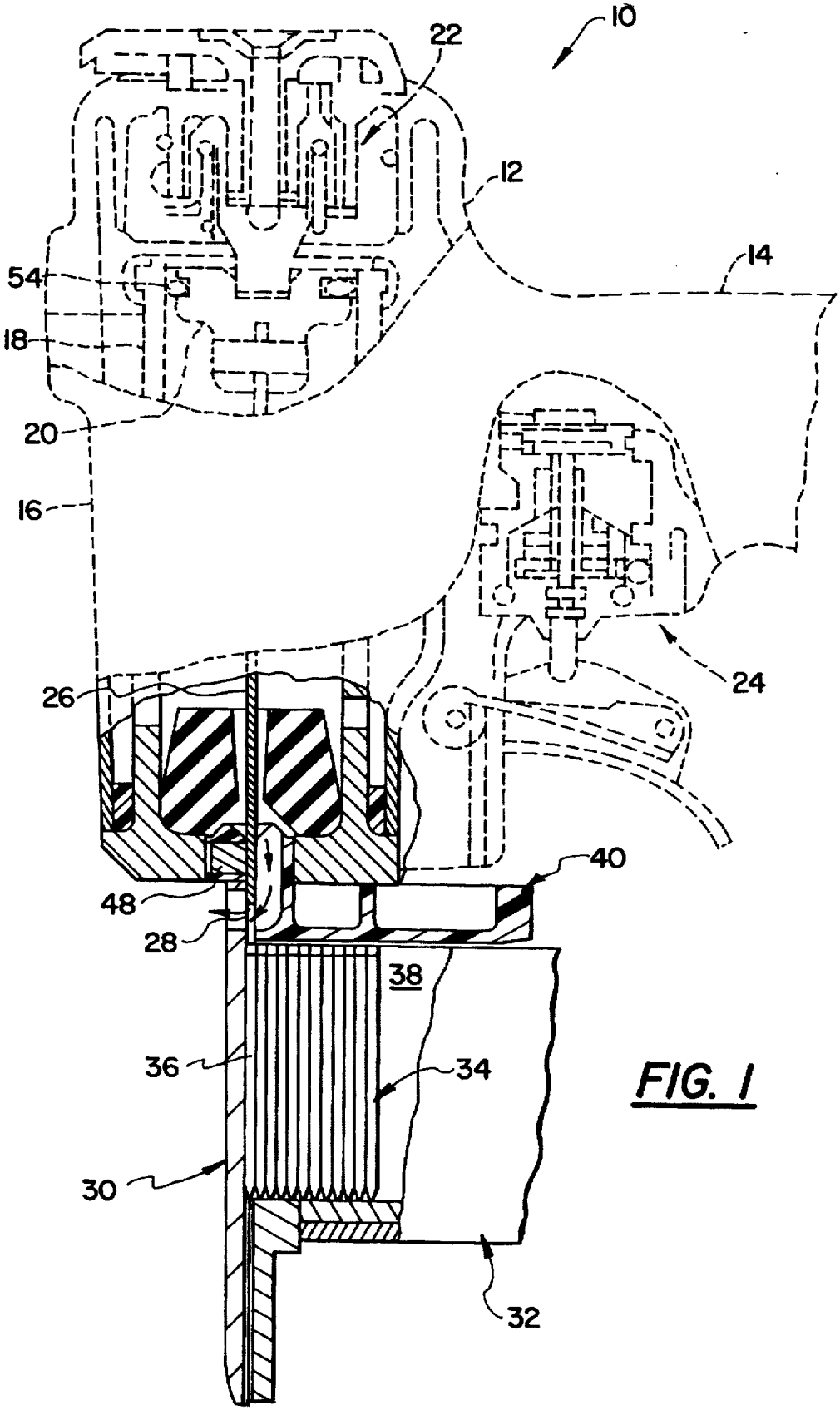
FIG. 1 is a side elevational view, partially in section, of a fastener driving tool including a magnet for biasing the fastener driving element, shown with portions of the tool in dotted lines for clarity of illustration.

Referring now more particularly to the drawings, there is shown in FIG. 1 thereof a portable, power operated fastener driving tool, generally indicated at 10, which embodies the principles of the present invention. The power operated tool illustrated is of the fluid pressure operating type and includes the usual portable housing, generally indicated at 12, which includes a handle grip portion 14 of hollow configuration which constitutes a reservoir for air under pressure coming from a source which is communicated therewith. The forward end of the handle portion intersects with a main body portion 16 of the housing 12. Mounted within the main housing portion 16 is a cylindrical member 18 defining a cylindrical chamber within which a piston 20 is slidably sealingly mounted for movement from an upper position through a drive stroke to a lowermost position and from the lowermost position through a return stroke back through its upper limiting position. A main valve, generally indicated at 22, is provided for controlling communication of the reservoir pressure to the upper end of the cylinder to effect the driving movement of the piston 20. Main valve 22 is pilot pressure operated and the pilot pressure chamber thereof is under control of a valve actuating mechanism, generally indicated at 24.

It will be understood that any type of pneumatic system may be utilized to actuate the tool as, for example, those shown in U.S. Pat. Nos. 3,708,096 and 4,039,113, the disclosures of which are hereby incorporated by reference into the present specification. While pneumatic systems are preferred, other systems, either power or manually operable, for effecting the cycle of operation of the fastener driving element may be utilized as, for example, electrical systems, spring actuated systems, hammer actuated systems, internal combustion actuated systems and the like.

A fastener driving element 26, of ferrous material, is connected to the piston 20 and is slidably mounted within a drive track 28 formed in the nose piece assembly, generally indicated at 30, forming a fixed part of the housing 12.

A magazine assembly, generally indicated at 32, is fixed to the nose piece assembly 30 and is operable to receive a supply of fasteners 34 and to feed the leading fastener 36 of the supply by a conventional pusher 38, into the drive track 28 to be driven therefrom by the fastener driving element 6. In the illustrated embodiment, the fasteners 34 are staples in the form of a staple stick.

Figure 2:
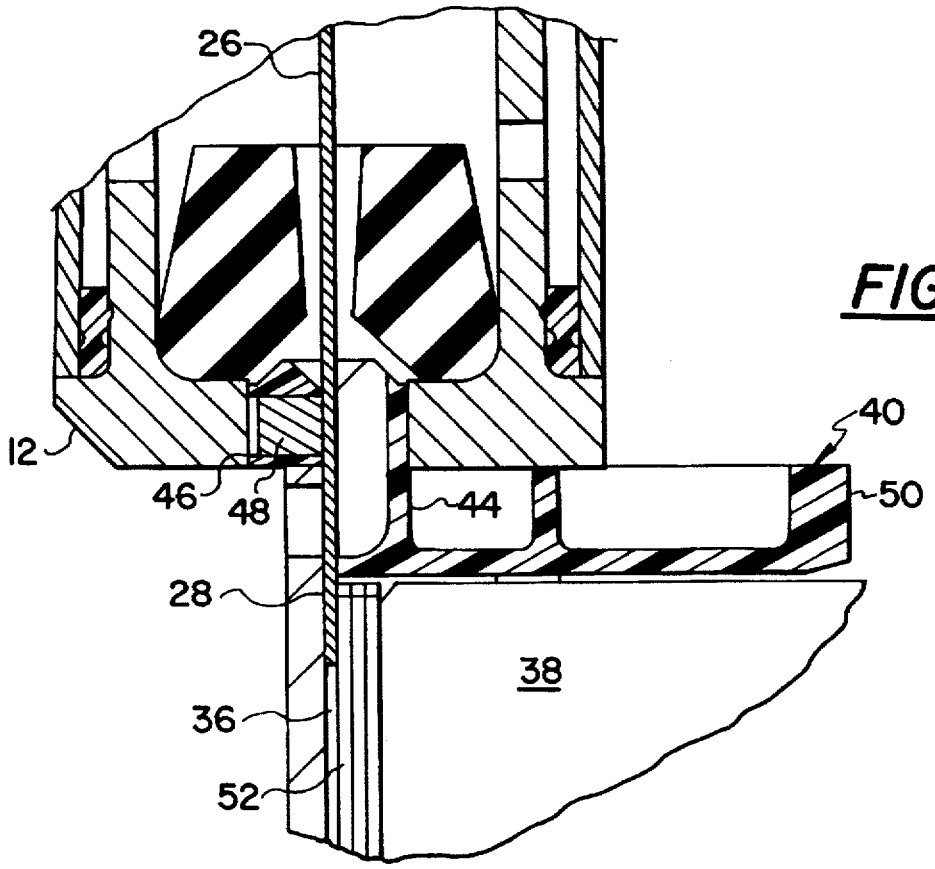
FIG. 2 is an enlarged, partial sectional view of a nose piece of the fastener driving tool of FIG. 1 shown with the magnet biasing the fastener driving element during a drive stroke thereof.
Figure 3:
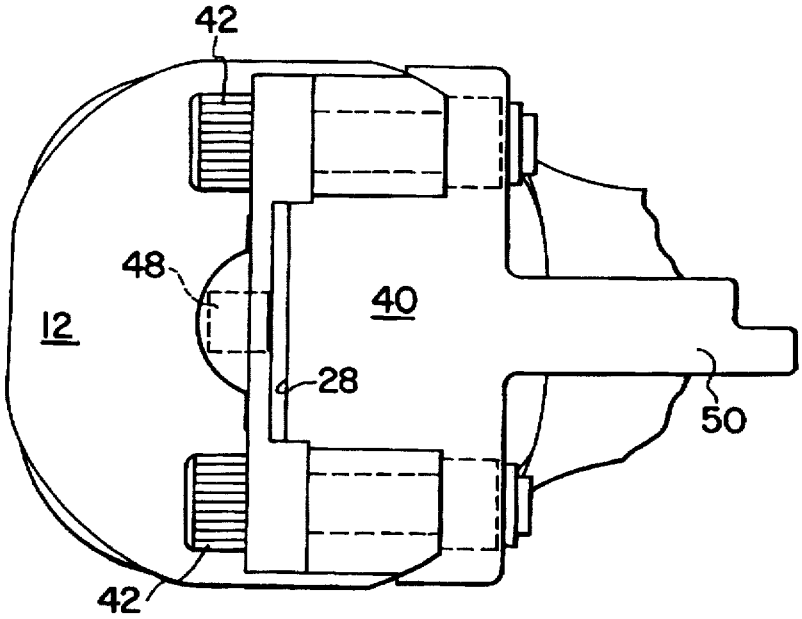
FIG. 3 is a bottom view of a portion of the housing of the tool of FIG. 1.

In the illustrated embodiment as best shown in FIG. 2, a removable housing element, generally indicated at 40, is coupled to a lower portion of the cylindrical member 18 via fasteners 42 (FIG. 3). The housing element 40 may be considered part of the housing 12 and includes a generally vertically extending portion 44 which defines a lower part of the drive track 28. A bore 46 is defined in portion 44 and is disposed generally transverse to the fastener drive track 28, in open communication therewith.

Mounted within the bore 46 is a magnet 48. The magnet 48 is mounted so as to be exposed to the drive track 28 for biasing the fastener driving element 26. The magnet 48 is preferably made of neodymium-iron-boron (NdFeB) and has a diameter of approximately 0.25 inches and a length of approximately 0.25 inches.

The housing element 40 also includes a guide portion 50, extending generally transversely from portion 44, which prevents the fasteners 34 in the magazine assembly 32 from moving upwardly while being biased by the pusher 38.

The function of the magnet 48 will be appreciated with respect to FIG. 2. As shown, the magnet 48 continuously biases the fastener driving element 26 in a direction in the feeding direction of the fasteners 34. Thus, during a fastener drive stroke, the leading fastener 36 is engaged by the fastener driving element 26 while the second, or adjacent fastener 52 will not be contacted by the fastener driving element 26.

If the leading fastener 36 is the last fastener of the series of fasteners 34, a portion of the pusher 38 may enter the drive track 28. During the fastener drive stroke, the leading fastener is engaged by the biased fastener driving element 26 with no contact, or minimal contact with the pusher 38, depending on tolerance stack-up. If the pusher is contacted, the contact is not sufficient to damage the pusher or cause the pusher to bind with the staple core.

In the illustrated embodiment, the fastener driving element 26 is of generally rectangular cross-section and has a thickness which is less than the thinnest fastener. This further ensures that the driving element 26 will not contact the second fastener 52 and will only have minimal contact with the pusher, if any, when a fastener is driven.

As noted above, the magnet 48 continuously biases the fastener driving element 26. Thus, when the piston 20 and fastener driving element 26 are disposed in their uppermost position at the end of the return stroke, the bias of the magnet 48 together with the frictional force between seal member 54 and the cylindrical member 18 maintains the piston 20 and fastener driving element 26 in the uppermost position. The piston 20 and fastener driving element 26 will remain in the uppermost position until they are forced downwardly by the air under pressure during the drive stroke of the tool.

It will be appreciated that the construction and arrangement of the biased fastener driving element 26 provides the following benefits.

If the fasteners are staples in the form of a stick, since the fastener driving element 26 will not strike the second fastener, the fastener stick is less likely to break and thus the fasteners may be continuously fed by the pusher 38.

Further, since the tolerances are such that the pusher 38 will not be contacted or will only have minimal contact with the fastener driving element 26 during a drive stroke, the pusher need not be heat-treated. Heat-treatment is conventionally required to strengthen the pusher to withstand significant contact with the fastener driving element.

Finally, since the driving element may only minimally contact the pusher 38, the pusher life is increased.

Thus, it will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all of the modifications encompassed within the spirit and scope of the following claims.

What is claimed is:

1. A fastener driving tool comprising:

a portable housing defining a fastener drive track;

a cylindrical chamber disposed within said housing;

a magazine assembly carried by the housing for receiving a supply of fasteners and for feeding successive fasteners in a feeding direction into the drive track;

a drive piston mounted for movement within said cylindrical chamber;

an elongated ferrous fastener driving element operatively connected with said drive piston and constructed and arranged to be moved through the drive track during repetitive fastener driving cycles, each of which fastener driving cycles includes a fastener drive stroke in one direction in which a fastener within the drive track is engaged by the driving element and moved outwardly of the drive track into a work piece, and a return stroke;

an actuating mechanism carried by the housing and being constructed and arranged to initiate movement of the drive piston and fastener driving element connected therewith through the fastener drive stroke; and a magnet mounted adjacent the drive track and being operatively associated with the fastener driving element so as to continuously bias the fastener driving element in the feeding direction of the successive fasteners such that during the drive stroke, the fastener driving element will engage a leading fastener of the successive fasteners without contacting an adjacent fastener of the supply.

2. The fastener driving tool according to claim 1, wherein said fasteners are jointed to form a fastener stick and said magazine assembly includes a pusher for feeding the successive fasteners in the feeding direction into the drive track, and when said leading fastener is the last fastener of said stick, said magnet biases the fastener driving element away from said pusher during the drive stroke of the fastener driving element.

3. A fastener driving tool according to claim 2, wherein said fasteners are staples and a said fastener driving element has a generally rectangular cross-section, a thickness of said fastener driving element being less than a thickness of the thinnest staple of the stick.

4. A fastener driving tool according to claim 1, wherein said housing includes a bore defined in a lower portion thereof, said bore being disposed generally transversely with respect to the fastener drive track and in open communication therewith, said magnet being mounted within said bore so as to be exposed to said drive track.

5. A fastener driving tool according to claim 1, wherein said housing includes a removable portion defining a lower part of the drive track, said magnet being disposed within said removable portion.

6. A fastener driving tool according to claim 1, further comprising a seal member carried by the piston and moveable therewith during the fastener drive stroke and the return stroke, said seal member being moveable in sliding relation with respect to said cylindrical chamber during said drive stroke and the return stroke, wherein said magnet applies a biasing force to said ferrous fastening driving element operable to retain the piston and the fastener driving element in an uppermost position within said cylindrical chamber prior to the fastener drive stroke.

7. A method of biasing a fastener driving element of a fastener driving tool, the tool including a portable housing defining a fastener drive track; a magazine assembly carried by the housing for receiving a supply of fasteners and for feeding successive fasteners in a feeding direction into the drive track; a ferrous fastener driving element mounted within the drive track for movement through repetitive cycles, each of which includes a fastener drive stroke in one direction in which a fastener within the drive track is engaged and moved outwardly of the drive track into a work piece, and a return stroke; a drive piston operatively connected with the fastener driving element for movement therewith; an actuating mechanism carried by the housing and being constructed and arranged to initiate movement of the fastener driving element through a fastener drive stroke; the method including:

continuously biasing the fastener driving element in the feeding direction of the successive fasteners with a magnet mounted with respect to the drive track such that during the drive stroke of the fastener driving element, the fastener driving element may engage a leading fastener of the successive fasteners without contacting an adjacent fastener of the supply.

* * * * *